US006605320B2

(12) United States Patent
Yoshida

(10) Patent No.: US 6,605,320 B2
(45) Date of Patent: Aug. 12, 2003

(54) STREAK-REDUCING COATING DEVICE AND METHOD

(75) Inventor: Yuko Yoshida, Sagaminara (JP)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/924,657

(22) Filed: Aug. 8, 2001

(65) Prior Publication Data

US 2002/0022092 A1 Feb. 21, 2002

(51) Int. Cl.[7] ..... B05D 3/12; B05C 11/02

(52) U.S. Cl. ..... 427/356; 427/8; 118/712; 118/410; 118/413; 118/419

(58) Field of Search ..... 427/356, 8; 118/410, 118/411, 413, 419, 712

(56) References Cited

U.S. PATENT DOCUMENTS

| | | | | |
|---|---|---|---|---|
| 3,678,849 A | | 7/1972 | Musgrave | |
| 4,029,833 A | | 6/1977 | Kosta | |
| 4,405,661 A | | 9/1983 | Alheid | |
| 4,899,691 A | * | 2/1990 | Fitzgerald, Jr. et al. | 118/410 |
| 5,085,168 A | | 2/1992 | Sollinger | |
| 5,109,792 A | | 5/1992 | Baldini | |
| 5,117,767 A | | 6/1992 | Sommer | |
| 5,136,941 A | | 8/1992 | Lubke et al. | |
| 5,138,970 A | | 8/1992 | Sollinger | |
| 5,186,753 A | | 2/1993 | Nakazawa et al. | |
| 5,302,203 A | | 4/1994 | Zimmer | |
| 5,460,119 A | | 10/1995 | Maroszek | |

* cited by examiner

*Primary Examiner*—Katherine A. Bareford
(74) *Attorney, Agent, or Firm*—Brian E. Szymanski

(57) ABSTRACT

A coating device for carrying out a die coating method, which is capable of rapidly and assuredly eliminating an undesirable streak occurring in a coating layer during the coating operation. The coating device includes a coating head spaced from a back-up roll, and a shifting mechanism for shifting the coating head close to and remote from the back-up roll. The shifting mechanism includes a reciprocation carriage mounted onto a stationary frame to be linearly reciprocatedly movable thereon, a drive section for reciprocating the reciprocation carriage on the stationary frame, and a stop section for selectively hindering the linear motion of the reciprocation carriage caused by the drive section at a desired position. The shifting mechanism operates to instantaneously reciprocate the coating head at a small distance so that a distance between the outer surface of the back-up roll now carrying out the coating operation and the coating face of the coating head temporarily increases.

20 Claims, 5 Drawing Sheets

STREAK-REDUCING COATING DEVICE AND METHOD

TECHNICAL FIELD OF THE INVENTION

This application is claiming priority to Japanese Application No. 2000-245539 filed Aug. 8, 2000, herein incorporated by reference in its entirety. The present invention relates to a coating device for forming a coating layer on a base web material, particularly to a coating device including a back-up roll carrying on an outer surface thereof a moving base web material and rotating therewith, and a coating head spaced from the back-up roll for continuously coating a surface of the moving base web material with a coating material.

PRIOR ART

There has been known, as a method for coating a surface of a base web material having a continuous length and a predetermined width such as resin film, rein sheet or paper with a coating material, a so-called die coating method wherein a nozzle section of an extrusion die is used as a coating head for continuously extruding a fluid coating material having a predetermined viscosity therefrom and forming a coating layer with predetermined thickness on the moving base material. The die coating method is advantageous in comparison with other known roll coating methods or knife coating methods when it is desired to obtain a thin coating layer with a uniform thickness. Die coating methods permit the formation of a thin coating layer in a precise and stable manner. In die coating applications, the thickness of the coating layer is directly adjustable by the adjustment of an extrusion rate of the coating material. In addition, the die coating methods prevent the premature drying of the coating material on the coating applicator thereby preventing associated problems such as streaking or uneven color in the resulting web.

One form of die coating method incorporates the use of a back-up roll type coating device. Back-up roll type coating devices generally involve a moving base web carried on a back-up roll and coated with a coating material supplied from an end surface; i.e. a coating face; of a nozzle of a coating head spaced at a predetermined distance from the surface of the base web. In the past, back-up roll type coating devices extrude a measured amount of coating material from the coating head through a small gap defined between the coating face of the coating head and the surface of the base web carried on the back-up roll. As a result, a coating layer of a predetermined thickness is continuously formed on the surface of the moving base web. An extremely sharp edge of a high linearity is formed at a downstream end of the coating face of the coating head as seen in the moving direction of the base web for the purpose of smoothing a surface of the coating layer. In this coating device, a thickness of the coating layer formed on the base web is controllable by adjusting both of an extrusion rate of the coating material and a distance between the coating head and the back-up roll.

Generally in the above-mentioned coating device, the coating head is provided with a coating material supply passage communicating with the coating face, through which the coating material is continuously supplied to the coating face in an extruding manner. The coating material supply passage opens at the coating face in a form extending in the transverse direction generally vertical to the moving direction of the base web, whereby a coating layer of a strip shape with a predetermined transverse dimension is formed on the surface of the base web. In this case, the coating material is supplied to the coating face under the interior pressure in the coating material supply passage, and applied to the surface of the base material while being pressed in the small gap (or a coating gap) between the coating face downstream from the coating material supply passage as seen in the moving direction of the base web and the surface of the base web carried on the back-up roll.

Another coating device of a back-up roll type is conventionally recognized as a lip coater or die coater. With a lip coater the coating material supply passage is sufficiently extended to cause the coating material supply passage to dwell therein so that the coating material is pressed substantially solely in the coating gap.

As described above, according to the back-up roll type coating device, a coating layer of a desired thickness is formed on the surface of the base web by delivering the coating material supplied to the coating face of the coating head onto the moving base material at a constant extrusion rate while pressing the coating material within the coating gap having a predetermined dimension. Accordingly, if particles or air bubbles of a size exceeding the dimension of the coating gap (generally several hundreds $\mu$m) are contained in the supplied coating material, the particle or air bubbles might block the coating gap to result in a linear pattern (or an undesirable streak) continuously extending in the moving direction of the web. If the coating head has the above-mentioned coating material supply passage, the blocking phenomenon caused by particles or air bubbles contained in the coating material may occur also in the coating material supply passage.

With conventional coating devices, when the streak occurs in the coating layer during the coating operation, the coating operation is suspended and a cleaning operation is carried out to remove the causative material for the blockade from the coating face or the coating material supply passage. For this purpose, the prior art coating device is provided with a shifting mechanism for shifting the coating head close to and away from the back-up roll so that a sufficient distance is obtained between coating face of the coating head and the base material carried on the back-up roll for carrying out the cleaning operation.

PROBLEMS TO BE SOLVED BY THE INVENTION

In the above-mentioned conventional back-up roll type coating device, the cleaning operation carried out when the undesirable streak occurs in the coating layer during the coating operation is, for example, an operation for manually wiping off the coating material from the coating face or scraping out the coating material from the coating material supply passage while suspending the supply of the coating material to the coating head after shifting the coating head to a position sufficiently remote from the back-up roll by driving the shifting mechanism. Such a cleaning operation itself is troublesome and requires much time and labor. In addition, the coating material may leak out on the coating face of the coating head to contaminate the same before the coating head resumes the operative position closer to the back-up roll after the completion of the cleaning. In such a case, there is a risk in that the coating material thus leaking is partially dried up to cause a new undesirable streak when the coating operation starts again.

It is actually difficult to completely remove such a leaking coating material by a manual operation. Because of the cleaning operation, not only a total time necessary for the coating operation is uselessly extended but also the coating material is wastefully consumed, which causes the production cost of a product with a coating layer to rise. Further, when the cleaning operation is carried out without stopping the movement of the base material to shorten the time necessary for the cleaning operation as much as possible, a portion of the base material having no coating layer must be treated as a waste. This further increases the production cost of the product with a coating layer due to the material loss.

An object of the present invention is to provide a high-performance coating device for carrying out the die coating method, capable of solving the above-mentioned problems of the prior art coating device of a back-up roll type, quickly and assuredly eliminating undesirable streaks in the coating layer if generated during the coating operation, and producing a product with a coating layer having a good quality (thickness uniformity, surface smoothness, presence of fault or others) while reducing the loss of coating material or base material to prevent the production cost from rising.

Means for Solving the Problems

To achieve the above object, according to the invention, a coating device is provided, comprising a back-up roll carrying on an outer surface thereof a moving base web material and rotating therewith, a coating head spaced from the back-up roll and including a coating face opposed to the outer surface of the back-up roll, a coating material being continuously supplied onto the coating face, and a shifting mechanism for shifting the coating head relative to the back-up roll, wherein the coating material is measured between the base web material carried on the outer surface of the back-up roll and the coating face of the coating head so that a coating layer with a predetermined thickness is continuously formed on a surface of the moving base web material, characterized in that the shifting mechanism can reciprocally shift the coating head to temporarily increase a distance between the outer surface of the back-up roll and the coating face of the coating head during a coating operation.

According to an implementation of the invention, in the coating device the shifting mechanism comprises a drive section for shifting the coating head between a first position where the coating head is close to the back-up roll to perform the coating operation and a second position where the coating head is remote from the back-up roll to suspend the coating operation, and a stop section for selectively hindering a movement of the coating head at a third position close to the first position during the movement of the coating head from the first position toward the second position caused by the drive section.

According to an implementation of the invention, in the coating device the drive section of the shifting mechanism acts to return the coating head from the third position to the first position just after the movement of the coating head is hindered by the stop section.

According to an implementation of the invention, in the coating device the stop section of the shifting mechanism includes a stopper member capable of selectively shifting between an operative position where the movement of the coating head is hindered and an inoperative position where the movement of the coating head is allowed.

According to an implementation of the invention, the stop section of the shifting mechanism can adjust a distance between the first and third positions of the coating head.

According to an implementation of the invention, the drive section of the shifting mechanism linearly shifts the coating head between the first and second positions.

According to an implementation of the invention, in the coating device the drive section of the shifting mechanism includes a cylinder unit and a linear guide.

According to an implementation of the invention, the shifting mechanism further comprises a position adjust section for optimizing a distance between the outer surface of the back-up roll and the coating face of the coating head when a coating operation is performed.

According to an implementation of the invention, in the coating device the position adjust section of the shifting mechanism includes a feed screw unit.

According to an implementation of the invention, the coating head further includes a coating material supply passage communicating with the coating face, the coating material being continuously supplied onto the coating face throughout the coating material supply passage in an extruding manner.

DETAILED DESCRIPTION

Figure 1:
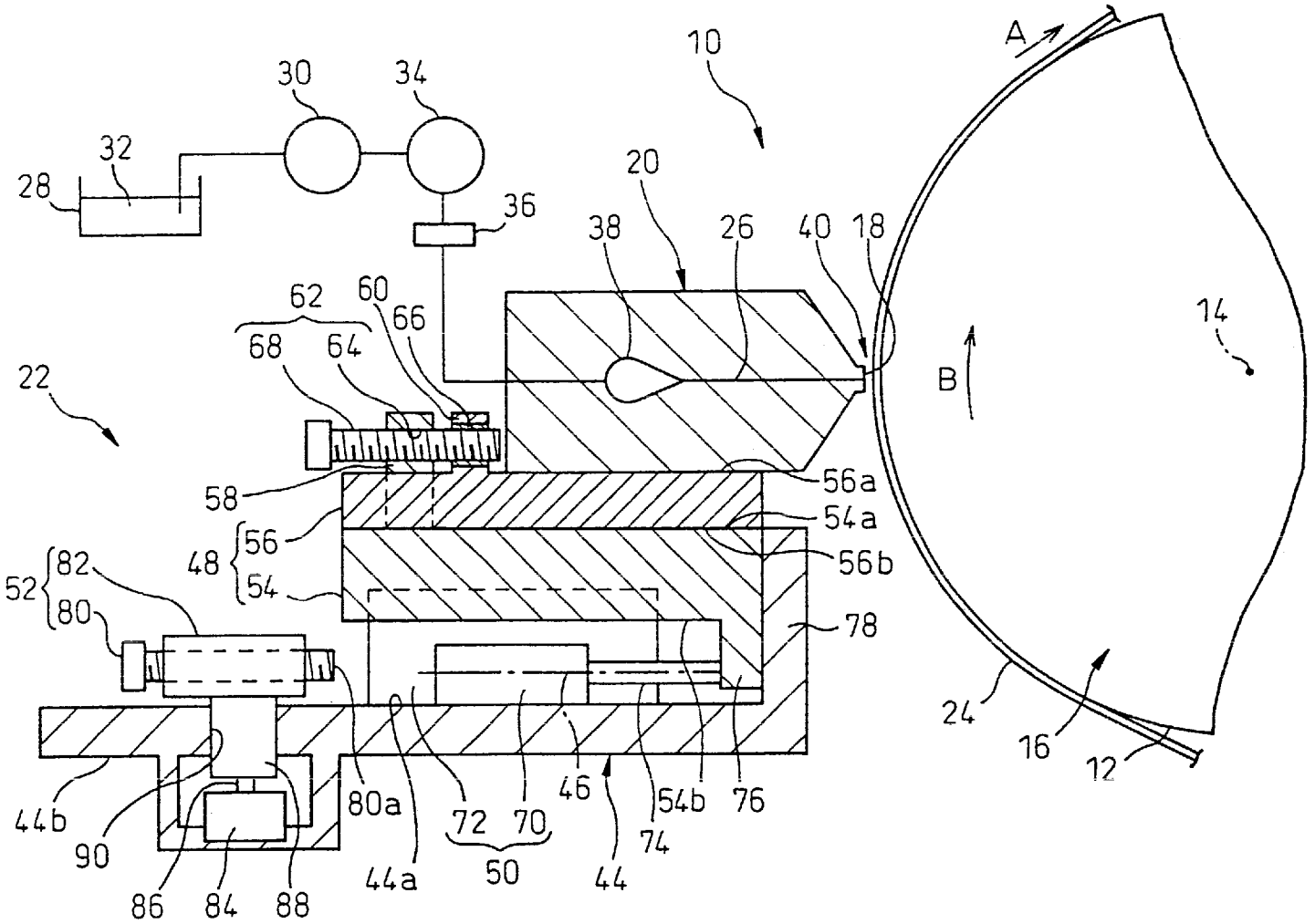
FIG. 1. A schematic front view of a coating device according to one aspect of the present invention, also showing a base web to be coated.

The preferred embodiments of the present invention will be described below in more detail with reference to the attached drawings wherein the same or similar constituent elements are indicated, respectively, by reference numerals common thereto.

Figure 2:
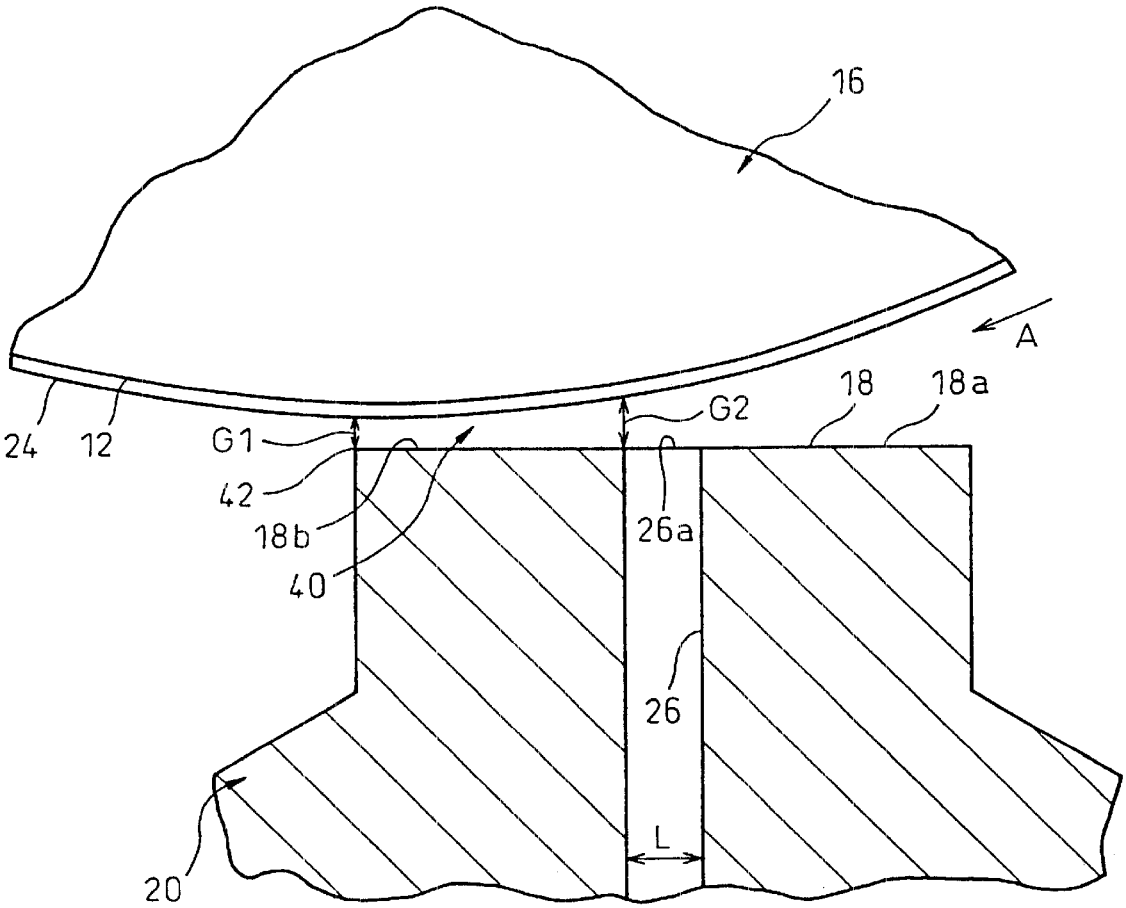
FIG. 2. An enlarged view of a main part of the coating device shown in FIG. 1.

With reference to the drawings, FIG. 1 is a schematic front view of a coating device 10 according to one embodiment of the present invention, and FIG. 2 is an enlarged view of a main part of the coating device 10. The coating device 10 is provided with a back-up roll 16 having a cylindrical outer surface 12 and rotating about a stationary axis 14, a coating head 20 spaced from the back-up roll 16 and having a coating face 18 opposed to the outer surface 12 of the back-up roll 16, and a shifting mechanism 22 for shifting the coating head 20 close to and remote from the back-up roll 16. The shifting mechanism 22 also has a function for finely adjusting a distance between the outer surface 12 of the back-up roll 16 and the coating face 18 of the coating head 20.

A base web 24 such as resin film, resin sheet or paper having a continuous length and a predetermined width is delivered from a web storage not shown to the back-up roll 16 and continuously moves at a predetermined speed in the arrowed direction A by the driving of a web delivery mechanism not shown while wrapped around a predetermined range of the outer surface 12 of the back-up roll 16. Simultaneously therewith, the back-up roll 16 smoothly rotates in the arrowed direction B about the axis 14 in conformity with the movement of the base web 24 while carrying the base web 24 on the outer surface 12 in tight contact therewith.

The coating head 20 constitutes a nozzle section of an extrusion die and has a flat coating face 18 and a coating material supply passage 26 communicating with the coating face 18. A fluid coating material 32 having a desired viscosity is continuously supplied from an external storage tank 28 to the coating head 20 by a pump device 30 through a feed system including a flow meter 34, a filter 36 or others. The coating material 32 supplied to the coating head 20 is continuously extruded onto the coating face 18 under pressure via the coating material supply passage 26 in accordance with a flow rate preset in the pump device 30 and continuously supplied to a space defined between the coating face 18 and the outer surface 12 of the back-up roll 16.

The coating material supply passage 26 opens at the coating face 18 while extending in the transverse direction generally vertical to the moving direction of the base web 24 carried on the back-up roll 16 (that is, a width-wise direction of the base web 24), and forms a coating layer of a strip shape having a predetermined width-wise dimension on a surface of the base web 24 with the continuously supplied coating material 32. At the upstream end of the coating material supply passage 26 is provided a tubular expanded section 38 extending in the transverse direction. The coating material 32 supplied from the pump device 30 to the coating material supply passage 26 initially spreads in the expanded section 38 uniformly in the transverse direction and flows into the coating material supply passage 26. Thereby, the pressure and flow rate distribution of the coating material 32 flowing through the coating material supply passage 26 becomes uniform all over the coating material supply passage 26 to form a coating layer having a uniform thickness in the width-wise direction on the surface of the base web 24.

As shown in an enlarged manner in FIG. 2, the coating surface 18 of the coating head 20 is divided into a first surface section 18*a* located on the upstream side and a second surface section 18*b* located on the downstream side as seen in the moving direction A of the base web relative to a center of an opening 26*a* of the coating material supply passage 26. The coating material extruded onto the coating face 18 is pressed and measured while fluidly flowing through a small gap 40 defined mainly between the second surface section 18*b* and the surface of the base web 24 carried on the back-up roll 16 (such a gap is referred to as a coating gap 40), and as a result, a coating layer having a predetermined thickness is continuously formed on the surface of the moving base web 24. An extremely sharp edge of a high linearity is formed at a downstream end 42 of the second surface section 18*b* of the coating face 18 for the purpose of smoothing a surface of the coating layer at a high accuracy.

A relative positional relationship exists between the back-up roll 16 and the coating head 20 so that the outer surface 12 of the back-up roll 16 and the coating face 18 of the coating head 20 are closest to each other at the downstream end 42 of the second surface section 18*b* of the coating face 18. Thereby, the coating gap 40 defined between the second surface section 18*b* of the coating face 18 and the surface of the base web 24 has a minimum dimension G1 at the downstream end 42 of the second surface section 18*b*, and has a maximum dimension G2 at an upstream end of the second surface section 18*b* defining the opening 26*a* of the coating material supply passage 26. According to such a configuration of the coating gap 40, a fluid pressure of the coating material 32 fluidly existing between the coating face 18 of the coating head 20 and the surface of the moving base web 24 rises as it approaches the downstream end 42 of the second surface section 18*b*, whereby a coating layer with a uniform thickness can be continuously formed on the surface of the base web 24 for a long time in a stable manner.

As described above, in the coating device 10, the coating layer having a uniform thickness is formed on the surface of the base web 24 by placing thereon the coating material 32 supplied in an extruding manner onto the coating face 18 of the coating head 20, pressing the coating material 32 at the coating gap 40 having a predetermined dimension and delivering the same at a constant rate. In this regard, although the coating material 32 supplied to the coating head 20 is filtrated by the filter 36 provided in the feed system so that impurities are removed therefrom to some extent, particles or air bubbles of extremely small size contained in the coating material 32 are difficult to be completely removed. Accordingly, if the particles or air bubbles having a size exceeding the dimension of the coating gap 40 (generally several hundreds $\mu$m) are contained in the coating material 32 filtrated by the filter 36, the coating gap 40 may be blocked with such particles or air bubbles, and as a result, an undesirable linear pattern (or a streak) continuously extending in the web-moving direction may occur in the coating layer. Also, the particles or air bubbles contained in the coating material 32 passing through the filter 36 may plug the coating material supply passage 26 before reaching the coating face 18, to result in a similar streak in the coating layer.

The coating device 10 as illustrated has an extremely useful structure capable of quickly and assuredly removing the particles or air bubbles contained in the coating material 32 blocking the coating gap 40 or the coating material supply passage 26, without substantially suspending the coating operation. That is, according to the coating device 10, the shifting mechanism 22 has a structure capable of instantaneously reciprocating the coating head 20 at a small distance to temporarily and slightly increase a distance between the outer surface 12 of the back-up roll 16 and the coating face 18 of the coating head 20 during the coating operation.

With reference again to FIG. 1, the shifting mechanism 22 includes a reciprocation carriage 48 provided on a stationary frame 44 to be linearly and reciprocally movable along a operation axis, a drive section 50 for reciprocating the reciprocation carriage 48 on the stationary frame 44, and a stop section 52 for selectively hindering the linear motion of the reciprocation carriage 48 derived from the drive section 50 at a desired position. The stationary frame 44 is located close to the back-up roll 16 so that the operation axis 46 of the reciprocation carriage 48 is substantially vertical to an axis of the rotation of the back-up roll 16. The coating head 20 is fixedly mounted onto the reciprocation carriage 48 so that the above-mentioned positional relationship is maintained relative to the back-up roll 16.

The reciprocation carriage 48 is formed of a first table 54 to which is applied a drive force from the drive section 50, and a second table 56 fixedly carrying the coating head 20. The first table 54 has an upper surface 54*a*, a lower surface 54*b* connected to the drive section 50, and a column 58 projecting from a position in the vicinity of an end of the upper surface 54*a* in an integral manner. The second table 56 has an upper surface 56*a* connected to the coating head 20, a flat lower surface 56*b*, and a column 60 projecting from a desired position of the upper surface 56*a* in an integral manner. The second table 56 is mounted onto the first table 54 so that the lower surface 56*b* is in surface-contact with the upper surface 54*a* to be slidable thereon.

In a preferred embodiment, the first table 54 and the second table 56 are functionally connected with each other via a precision feed screw device 62. The precision feed screw device 62 is provided with a female screw 64 formed in the column 58 of the first table 54, and a male screw 68 rotatably held in the column 60 of the second table 56 via a bearing 66 and screw-engaged with the female screw 64 of the first table 54. The precision feed screw device 62 shifts the reciprocation carriage 48 on the first table 54 in a reciprocating manner in the direction parallel to the operation axis 46 of the reciprocation carriage 48 by rotating the male screw 68, and as described later, functions as a position-adjustment section for optimizing a distance between the outer surface 12 of the back-up roll 16 and the coating face 18 of the coating head 20 during the coating operation.

In a preferred embodiment, the drive section 50 is provided with a cylinder device 70 and a linear guide 72, each of which is fixedly mounted onto the upper surface 44*a* of the stationary frame 44. The cylinder device 70 is, for example, a dual acting pneumatic cylinder, in which a front end of its piston rod 74 defining the operation axis 46 is fixedly connected to a wall 76 extending from the lower surface 54*b* of the first table 54 of the reciprocation carriage 48. The linear guide 72 is slidably engaged with the first table 54 and carries the same to be linearly movable in the direction parallel to the operation axis 46. By controlling the cylinder device 70, the drive section 50 linearly reciprocates the coating head 20 carried on the reciprocation carriage 48 between a first position or a forward position (see FIG. 1) closer to the back-up roll 16 at which the coating operation is carried out and a second position or a backward position (see FIG. 3) remote from the back-up roll 16 at which the coating operation is suspended.

An abutment wall 78 is provided on the upper surface 44*a* of the stationary frame 44 in integral therewith along a front edge thereof (that is, an edge positioned on one side corresponding to the coating face 18 of the coating head 20 mounted on the reciprocation carriage 48) to be opposed to the first table 54 of the reciprocation carriage 48 moving in the forward direction. The abutment wall 78 operates to abut to a front end surface (that is, an end surface positioned on the one side corresponding to the coating face 18 of the coating head 20) of the first table 54 of the reciprocation carriage 48 when the coating head 20 reaches the first position by the action of the drive section 50 and accurately locate the coating head 20 at the first position.

Figure 6:
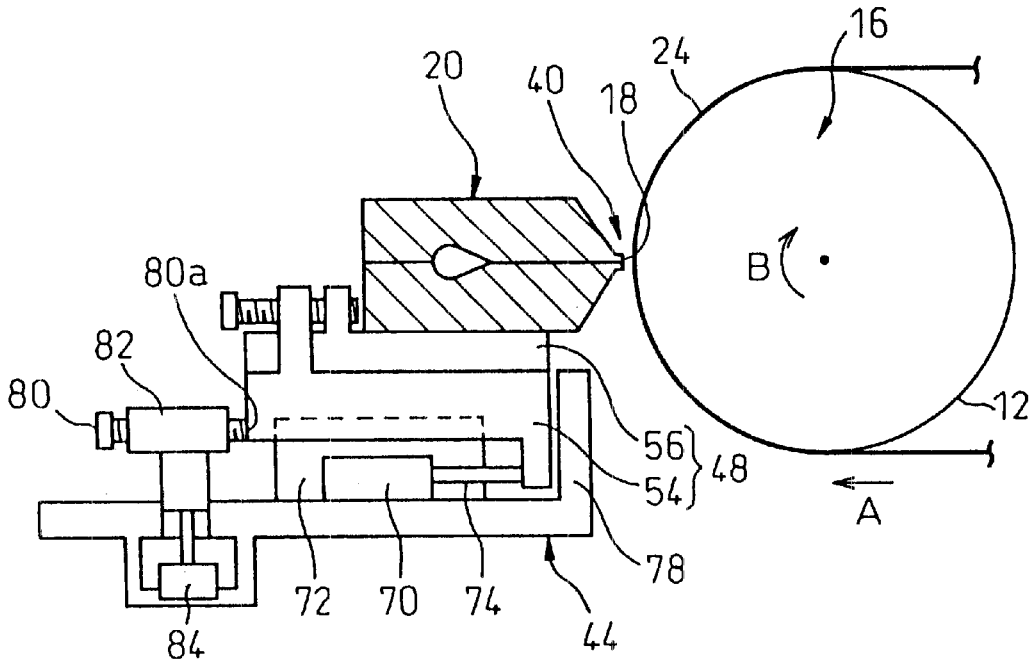
FIG. 6. An illustration corresponding to FIG. 3 showing the coating device wherein the coating head is at a third position so that a coating gap is slightly extended.

Preferably, the stop section 52 is provided on the stationary frame 44 opposite to the abutment wall 78 while interposing the drive section 50, and the stop section 52 operates to selectively hinder the movement of the coating head 20 at a third position (see FIG. 6) in the vicinity of the first position while the drive section 50 causes the coating head 20 to retreat from the first position to the second position. The stop section 52 is preferably provided with a stop member 80 formed of a male screw and a support member having a female screw engaged with the stop member 80. The stop member 80 and the support member 82 constitutes, in association with each other, a precision screw device. The stop member 80 is positioned so that the axis thereof is parallel to the operation axis 46 of the reciprocation carriage 48, and reciprocates along the operation axis 46 when rotating. Thereby, a distance between the first and third positions of the coating head 20 is adjustable as described later.

Figure 5:
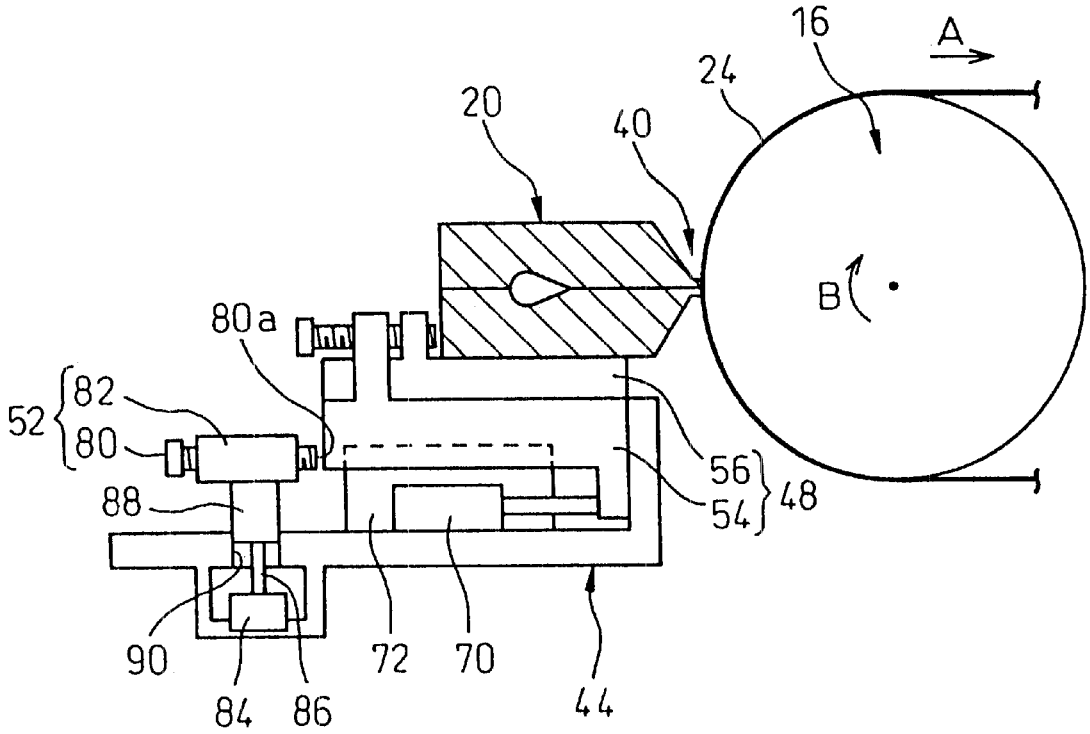
FIG. 5. An illustration corresponding to FIG. 3 showing the coating device in an operative state wherein the coating head is at the first position and a stop member is at an operative position.

In the preferred embodiment, the stop section 52 is further provided with a second cylinder device 84 for selectively shifting the stop member 80 between an operative position (see FIG. 5) to hinder the backward motion of the coating head 20 and a non-operative position (see FIG. 3) to allowing the backward motion. The cylinder device 84 is, for example, a dual acting pneumatic cylinder in which a body portion thereof is fixedly mounted to the stationary frame 44 on a side closer to the lower surface 44*b* and a front end of its piston rod 86 is fixedly connected to an extension 88 of the support member 82 projecting downward therefrom. The extension 88 of the support member 82 is slidably accommodated in a through-hole 90 extending in the direction generally vertical to the operation axis 46 at a position between the upper surface 44*a* and the lower surface 44*b* of the stationary frame 44. Therefore, the stop section 52 linearly reciprocates the stop member 80 supported by the support member 82 between the operative position and the non-operative position in the direction generally vertical to the operation axis 46 by controlling the cylinder device 84. In this regard, when the stop member 80 is located at the operative position, the front end surface 80*a* of the stop member 80 is disposed against the first table 54 of the reciprocation carriage 48 in the backward direction (FIG. 5).

A mode of operation of the shifting mechanism 22 of the above noted preferred structure will be described with reference to FIGS. 3 to 6.

Figure 3:
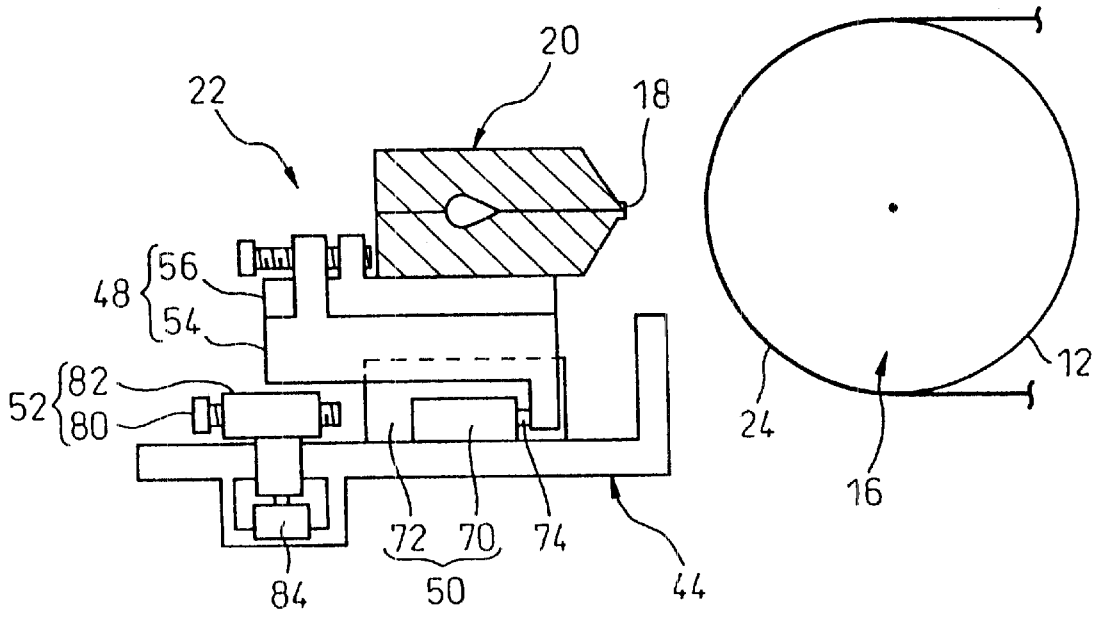
FIG. 3. A schematic front view of a shifting mechanism in the coating device shown in FIG. 1 in a resting state wherein a coating head is at a second position.
Figure 4:
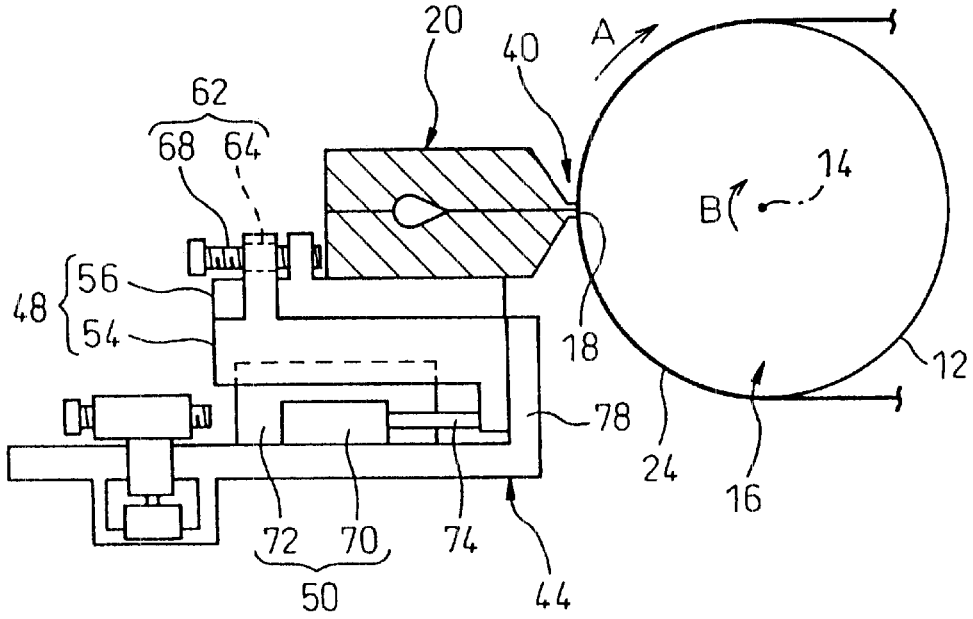
FIG. 4. An illustration corresponding to FIG. 3 showing the coating device in an operative state wherein the coating head is at a first position.

First, as shown in FIG. 3, while the coating operation is suspended, the piston rod 74 is drawn into the cylinder device 70 of the drive section 50 to move the reciprocation carriage 48 on the stationary frame 44 to the rearmost position of the shifting stroke, whereby the coating head 20 is located at the second position (backward position) remote from the back-up roll 16. At this instant, the stop member 80 of the stop section 52 is located at the non-operative position by the action of the cylinder device 84 and disposed beneath the rear portion of the first table 54 of the reciprocation carriage 48 together with the support member 82.

Upon starting the coating operation, the base web 24 is wrapped around a predetermined range of the outer surface 12 of the back-up roll 16 as shown in FIG. 3, and the piston rod 74 of the cylinder device 70 of the drive section 50 extends to shift the reciprocation carriage 48 forward on the stationary frame 44 along the linear guide 72. And, when the front end surface of the first table 54 of the reciprocation carriage 48 abuts to the abutment wall 76 of the stationary frame 44, the reciprocation carriage 48 is disposed at the foremost position of the shifting stroke, whereby the coating head 20 is located at the first position (forward position) closest to the back-up roll 16 (see FIG. 4).

In this state, the coating face 18 of the coating head 20 is slightly apart from the outer surface of the back-up roll 16, so that a small gap; i.e., a coating gap 40; is defined between the surface of the base web 24 wrapped around the back-up roll 16 and the coating face 18 of the coating head 20. Then, simultaneously with continuously moving the base web 24 in the arrowed direction A at a predetermined speed, the pump device 30 (FIG. 1) operates to continuously extrudes the coating material to the coating face 18 of the coating head 20 to form a coating layer on the surface of the base web 24.

At this time, the operator rotates the male screw 68 of the precision feed screw device 62 while observing a state of the coating layer now being formed to shift the second table 56 of the reciprocation carriage 48 at a small distance on the first table 54 closer to or away from the back-up roll 16 rotating in the arrowed direction B. According to this fine adjustment, the distance between the outer surface 12 of the back-up roll 16 and the coating face 18 of the coating head 20, that is, the dimension of the coating gap is optimized to enable a coating layer of a uniform thickness to be evenly and stably formed on the surface of the continuously moving base web 24. While maintaining the coating head 20 at the first position thus finely adjusted, the coating operation is continuously carried out.

While taking into account the possibility of the occurrence of undesirable streaks in the coating layer formed on the base web, the stop member 80 of the stop section 52 is preliminarily shifted from the non-operative position to the operative position by the action of the cylinder device 84 during the coating operation as shown in FIG. 5. At this time, the stop member 80 is smoothly shifted to the operative position together with the support member 82 by the guiding action of the extension 88 of the support member 82 in association with the through-hole 90 of the stationary frame 44. At the operative position, the front end surface 80*a* of the stop member 80 is opposed at a predetermined distance to the rear end surface of the first table 54 of the reciprocation carriage 48.

In this state, when the streak occurs in the coating layer during the coating operation, it is possible to rapidly draw-in the piston rod 74 by the action of the cylinder device 70 to quickly move the reciprocation carriage 48 backward together with the coating head 20 on the stationary frame 44, without suspending the coating operation but while continuing the movement of the base web 24 and the supply of the coating material. At this time, since the stop member 80 of the stop section 52 disposed at the operative position is present in a path of the backward movement of the reciprocation carriage 48, the front end surface 80*a* of the stop member 80 abuts to the rear end surface of the first table 54 of the reciprocation carriage 48 to forcibly stop the reciprocation carriage 48 (see FIG. 6). In such a manner, the coating head 20 stops at the third position in the vicinity of the first position during the movement thereof from the first position to the second position to temporarily increase a distance between the outer surface 12 of the back-up roll 16 and the coating face 18 of the coating head 20 so that the dimension of the coating gap 40 is rapidly enlarged.

If the undesirable streak is caused by the blockade of the coating gap 40 with the particles or air bubbles contained in the coating material, such particles or air bubbles are discharged from the coating gap 40 while riding on the coating layer formed on the continuously moving base web 24 upon the enlargement of the dimension of the coating gap 40. On the other hand, if the blockade with the particles or air bubbles contained in the coating material occurs in the coating material supply passage 26 of the coating head 20, the pressure of the coating material in the coating gap 40 is instantaneously released by the rapid enlargement of the dimension of the coating gap 40, whereby the particles or air bubbles are pushed out from the coating material supply passage 26 together with the coating material by the coating material supply pressure and discharged from the coating gap 40 while riding on the coating layer formed on the base web 24.

Immediately after removing the causative material for the streak from the coating gap 40 and the coating material supply passage 26 in such a manner, the cylinder device 70 operates to rapidly extend the piston rod 74, whereby the reciprocation carriage 48 quickly moves forward together with the coating head 20 on the stationary frame 44 to return the coating head 20 to the finely adjusted first position (see FIG. 5). In such a manner, the streak is quickly and assuredly remedied without substantially suspending the coating operation to enable the coating layer with a uniform thickness to be again continuously formed on the continuously moving base web 24 in a stable manner.

In the above-mentioned process for remedying the undesirable streak by the operation of the shifting mechanism 22, a backward displacement of the coating head 20 from the first position to the third position may be as small as approximately several hundreds $\mu$m. That is, while the dimension of the coating gap 40 capable of forming the coating layer of a uniform thickness on the base web 24 is generally relied on a viscosity or a supply pressure of the coating material, the coating gap may be formed by the backward displacement of the coating head 20 to such an extent as capable of assuredly discharging the causative material for the streak therefrom in accordance with the above steps, wherein the causative material blocks a wider one of the coating gap 40 and the coating material supply passage 26 of a fixed dimension. Also, a time duration necessary for moving the coating head 20 backward from the first position to the third position and then returning the same to the first position may be extremely short, for example, several milliseconds, although varying in accordance with the moving speed of the base web 24. A relatively instantaneous reciprocation can prevent excessive coating material from leaking out to the coating face 18 and partially drying up.

Such a small displacement distance of the coating head 20 as from the first position to the third position is finely adjustable by rotating the stop member 80 of the stop section 52 relative to the support member 82. Upon the adjustment, after the reciprocation carriage 48 and the stop section 52 is disposed as shown in FIG. 5, a shim (not shown) having a thickness corresponding to the required displacement distance of the coating head 20 from the first position and the third position is interposed between the front end surface 80*a* of the stop member 80 and the rear end surface of the first table 54, and the stop member 80 is rotated to occupy a position at which the shim is nipped.

As described above, according to the coating device 10 of this embodiment, streaks generated in the coating layer on the base web 24 during the coating operation are quickly and assuredly remedied without suspending the coating operation as in the conventional cleaning operations which generally require movement of the coating head 20 backward to a position (for example, the second position) sufficiently remote from the back-up roll 16 to enable manual scraping or cleaning of the coating material. Thus, since the troublesome manual operation is avoidable, the increase in a total time necessary for the coating operation due to the cleaning operation is prevented. In addition, since it is possible to reduce a loss of the coating material 32 and the base web 24 as much as possible by carrying out the streak eliminating process described above immediately after the streak is detected, the rise of the production cost of a product with a coating layer is effectively suppressed.

Also, since the preferred shifting mechanism 22 of the coating device 10 may be constituted, for example, by solely adding the stop section 52 to the shifting mechanism provided in the prior art coating device for the purpose of moving the coating head to a resting position (second position), it is possible to prevent the installation cost from rising. Further, since the cylinder device 70 for the drive section 50 and the cylinder device 84 for the stop section 52 are operative under the control of a common controller (not shown) for the coating device 10, it is possible to automate the streak eliminating process by providing a sensor (not shown) for detecting the streak in the coating layer. Also it is possible to automate the operation for rotating the male screw 68 of the precision feed screw device 62 and the operation for rotating the stop member 82 of the stop section 52 by providing a drive source such as a servo-motor or the like. Thus, according to the coating device 10, it is possible to precisely carry out the coating operation by the automation of the streak elimination process to obtain a product with a coating layer excellent in quality (thickness uniformity, surface smoothness, presence of fault).

The coating device according to the present invention may have various structures other than described above. In general, any conventionally recognized shifting devices for reciprocating the coating device may be suitable for use with the present invention. For example, the dual acting pneumatic cylinder used in the cylinder device 70 for the drive section 50 or the cylinder device 84 for the stop section 52 of the coating device 10 may be of another type such as an electric cylinder, hydraulic cylinder or the like. Or, a servo-motor or others may be adopted as a drive source for the drive section 50 or the stop section 52, instead of the cylinder device 70 or 84. In this regard, in view of the safety when used in the combustible solvent vapor environment, the above-mentioned pneumatic cylinder is favorably adopted.

The coating device 10 is provided with the reciprocation carriage 48 carrying the coating head 20 thereon and the stop section 52, both of which are mounted onto the stationary frame 44 common thereto. This structure is advantageous for establishing the high accuracy in the relative positioning. However, the stop section 52 may be provided independently from the stationary frame 44. In the illustrated embodiment, the coating head 20 is horizontally disposed on the lateral side of the back-up roll 16 to be movable in the horizontal direction. However, the coating head 20 is not limited thereto but may be vertically disposed beneath the back-up roll 16 to be movable in the vertical direction. In this structure, the driving force for shifting the coating head 20 from the first position to the second or third position may be obtained not only from the drive section but also by the gravity.

Figure 7:
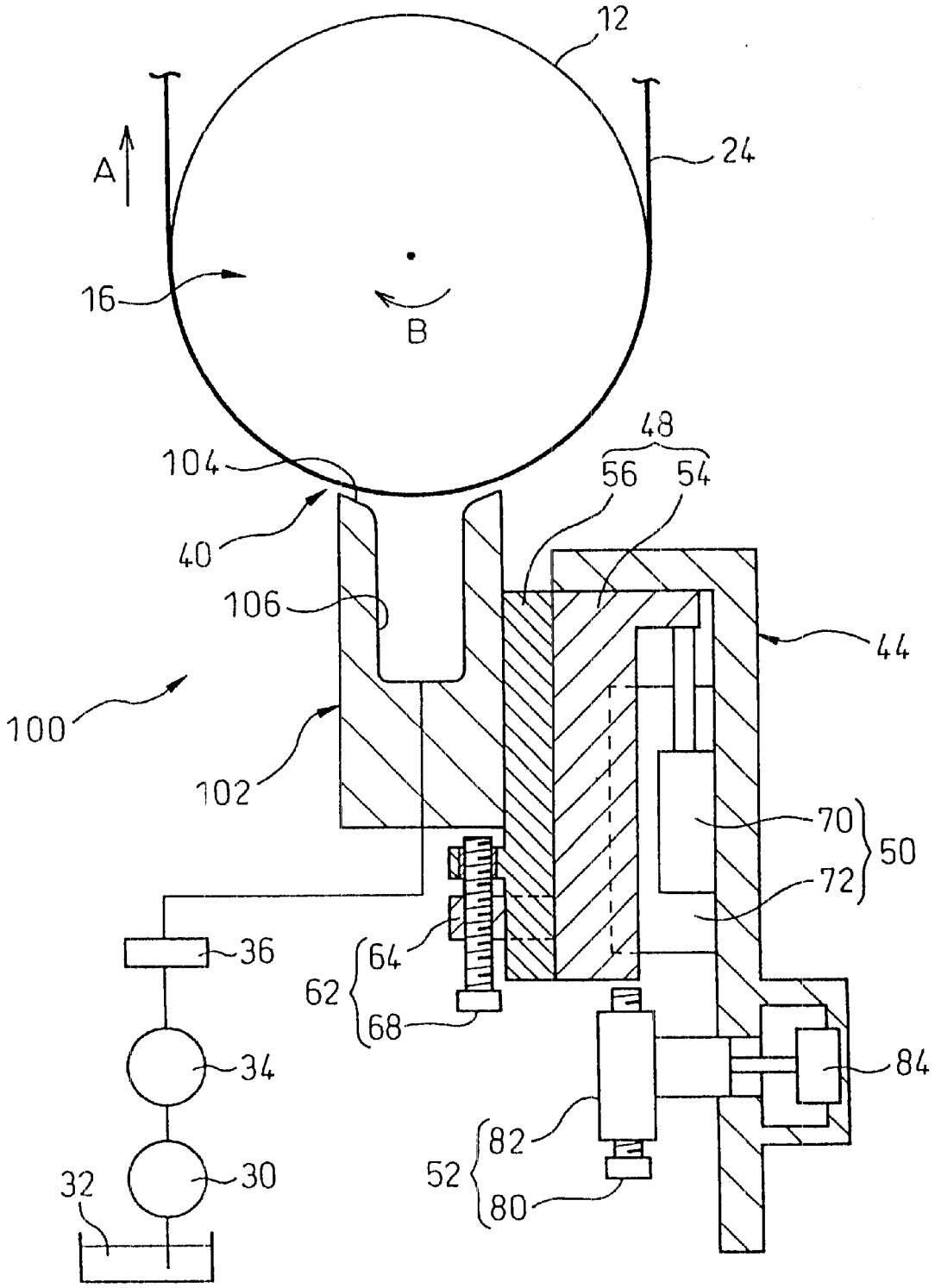
FIG. 7. A front view of a coating device according to another aspect of the present invention together with a base web to be coated.

The present invention is also applicable to a coating device with a coating head of a structure different from that of the coating head 20. FIG. 7 schematically illustrates such a coating device 100 according to another embodiment of the present invention. Since the coating device 100 has substantially the same structure as that of the abovementioned coating device 10 except for a coating head 102, the same reference numerals are used for indicating the corresponding constituent elements and the description thereof will be eliminated. The coating head 102 of the coating device 100 is adapted to press the supplied coating material 32 substantially solely in the coating gap 40.

The coating head 120 is provided with a curved coating face 104 and a coating material dwelling section 106 communicating with the coating face 104. The fluid coating material 32 with a desired viscosity is continuously supplied from the external storage tank 28 to the coating head 102 via the supply system including the flow meter 34, the filter 36 or others. The coating material 32 supplied to the coating head 102 is continuously delivered onto the coating face 104 in accordance with a flow rate preset in the pump device 30. The coating material delivered to the coating face 104 is pressed and measured while fluidly passing through the coating gap 40 formed between the coating face 104 and the surface of the base web 24 carried on the back-up roll 16, and as a result, a coating layer of a predetermined thickness is continuously formed on the surface of the moving base web 24. At a downstream end 108 of the coating face 104, an extremely sharp edge with a high linearity is formed for highly precisely smoothing the surface of the coating layer.

In the coating device 100, the coating head 102 is vertically disposed beneath the back-up roll 16 so that the coating face 104 is directed upward. Corresponding thereto, the reciprocation carriage 48 carrying the coating head 102 thereon is adapted to be movable upward and downward by the action of the drive section 50 while orienting the operation axis 46 in the vertical direction. The coating head 102 is linearly reciprocated by the action of the drive section 50 of the cylinder device 70 between a first position in the vicinity of the back-up roll 16 at which the coating operation is carried out and a second position remote from the back-up roll 16 at which the coating operation is suspended.

The stop section 52 is provided on the common stationary frame 44 at a position beneath the reciprocation carriage 48, for selectively hindering the shifting motion of the coating head 102, when the drive section 50 causes the coating head 102 to shift from the first position to the second position, at the third position in the vicinity of the first position. It is possible to rapidly and assuredly to eliminate the streak by instantaneously reciprocating the coating head 102 between the first position and the third position when the streak is generated in the coating layer formed during the coating operation on the base web 24, as described with reference to the coating device 10.

EXAMPLE

The coating device 10 shown in FIG. 1 having the coating gap 40 of the minimum dimension G1 of 200 $\mu$m and the coating material supply passage 26 of the dimension L in the moving direction of 500 $\mu$m was used for continuously forming a coating layer of a predetermined thickness on a base web 24 of PET (polyethylene terephthalate) having a thickness of 50 $\mu$m moving at a speed of 50 m/min with a coating material having a viscosity of 5 cps, in which an organic pigment is dispersed. When an undesirable streak was generated in the coating layer during the coating operation, the coating head 20 reciprocated for about 0.2 seconds between the first and third positions. As a result, a particle of a size approximately 250 $\mu$m blocking up the coating gap 40 was discharged from the coating gap 40 while riding on the coating layer.

Effect of the Invention

As apparent from the above description, according to the present invention, even if a streak occurs in the coating layer during the coating operation of the coating device for carrying out the die coating method, it is possible to rapidly and assuredly eliminate the streak and obtain a product with a coating layer excellent in quality (thickness uniformity, surface smoothness, presence of fault) while suppressing the rise of production cost by reducing a loss of coating material and base web.

It is claimed:

1. A method for coating a web comprising:

(a) providing a back-up roll carrying on an outer surface thereof a moving base web material and rotating therewith;

(b) providing a coating head spaced from said back-up roll and including a coating face opposed to said outer surface of said back-up roll; and (c) continuously applying a coating material onto said coating face, said coating head connected to a shifting mechanism for shifting said coating head relative to said back-up roll, wherein the coating material is applied between the base web material carried on said outer surface of said back-up roll and said coating face of said coating head so that a coating layer with a predetermined thickness is continuously formed on a surface of the moving base web material, and wherein said shifting mechanism reciprocally shifts said coating head to temporarily change a distance between said outer surface of said back-up roll and said coating face of said coating head during a coating operation to release materials causing streaking in the coating layer.

2. A method as set forth in claim 1, wherein said shifting mechanism comprises a drive section for shifting said coating head between a first position where said coating head is close to said back-up roll to perform the coating operation and a second position where said coating head is remote from said back-up roll to suspend the coating operation, and a stop section for selectively hindering a movement of said coating head at a third position closer to said first position than to said second position during the movement of said coating head from said first position toward said second position caused by said drive section.

3. A method as set forth in claim 2, wherein said drive section of said shifting mechanism acts to return said coating head from said third position to said first position just after said movement of said coating head is hindered by said stop section.

4. A method as set forth in claim 2, wherein said stop section of said shifting mechanism includes a stopper member capable of selectively shifting between an operative position where said movement of said coating head is hindered and an inoperative position where said movement of said coating head is allowed.

5. A method as set forth in claim 2, wherein said stop section of said shifting mechanism can adjust a distance between said first and third positions of said coating head.

6. A method as set forth in claim 2, wherein said drive section of said shifting mechanism linearly shifts said coating head between said first and second positions.

7. A method as set forth in claim 6, wherein said drive section of said shifting mechanism includes a cylinder unit and a linear guide.

8. A method as set forth in claim 1, wherein said shifting mechanism further comprises a position adjust section for optimizing a distance between said outer surface of said back-up roll and said coating face of said coating head when a coating operation is performed.

9. A method as set forth in claim 8, wherein said position adjust section of said shifting mechanism includes a feed screw unit.

10. A method as set forth in claim 1, wherein said coating head further includes a coating material supply passage communicating with said coating face, the coating material being continuously supplied onto said coating face through said coating material supply passage in an extruding manner.

11. A coating device comprising a back-up roll carrying on an outer surface thereof a moving base web material and rotating therewith, a coating head spaced from said back-up roll and including a coating face opposed to said outer surface of said back-up roll, a coating material being continuously supplied onto said coating face, a shifting mechanism for shifting said coating head relative to said back-up roll, and a sensor for detecting a streak in the coating material, wherein the coating material is supplied between the base web material carried on said outer surface of said back-up roll and said coating face of said coating head so that a coating layer with a predetermined thickness is continuously formed on a surface of the moving base web material, wherein said shifting mechanism can reciprocally shift said coating head after the sensor has detected a streak in the coating material to temporarily change a distance between said outer surface of said back-up roll and said coating face of said coating head during a coating operation so as to reduce streaking in the coating layer.

12. A coating device as set forth in claim 11, wherein said shifting mechanism comprises a drive section for shifting said coating head between a first position where said coating head is sufficiently close to said back-up roll to perform the coating operation and a second position where said coating head is remote from said back-up roll to suspend the coating operation, an a stop section for selectively hindering a movement of said coating head at a third position close to said first position during the movement of said coating head from said first position toward said second position caused by said drive section.

13. A coating device as set forth in claim 12, wherein said drive section of said shifting mechanism acts to return said coating head from said third position to said first position just after said movement of said coating head is hindered by said stop section.

14. A coating device as set forth in claim 12, wherein said stop section of said shifting mechanism includes a stopper member capable of selectively shifting between an operative position where said movement of said coating head is hindered and an inoperative position where said movement of said coating head is allowed.

15. A coating device as set forth in claim 12, wherein said stop section of said shifting mechanism can adjust a distance between said first and third positions of said coating head.

16. A coating device as set forth in claim 12, wherein said drive section of said shifting mechanism linearly shifts said coating head between said first and second positions.

17. A coating device as set forth in claim 16, wherein said drive section of said shifting mechanism includes a cylinder unit and a linear guide.

18. A coating device as set forth in claim 11, wherein said shifting mechanism further comprises a position adjust section for optimizing a distance between said outer surface of said back-up roll and said coating face of said coating head when a coating operation is performed.

19. A coating device as set forth in claim 18, wherein said position adjust section of said shifting mechanism includes a feed screw unit.

20. A coating device as set forth in claim 11, wherein said coating head further includes a coating material supply passage communicating with said coating face, the coating material being continuously supplied onto said coating face through said coating material supply passage in an extruding manner.

* * * * *

UNITED STATES PATENT AND TRADEMARK OFFICE

CERTIFICATE OF CORRECTION

PATENT NO. : 6,605,320 B2
DATED : August 12, 2003
INVENTOR(S) : Yoshida, Yuko

It is certified that error appears in the above-identified patent and that said Letters Patent is hereby corrected as shown below:

Column 3,
Line 22, delete “invention,” and insert -- invention as set forth in claim 1, --.
Line 40, after “device” insert -- as set forth in claim 1, --.
Line 52, after “device” insert -- as set forth in claim 2, --.
Line 57, after “device” insert -- as set forth in claim 2, --.

Column 4,
Line 2, after “device” insert -- as set forth in claim 6, --.
Line 10, after “device” insert -- as set forth in claim 8, --.

Column 11,
Lines 53-54, delete “abovementioned” and insert -- above-mentioned --.

Column 12,
Line 9, delete “linearity” and insert -- linearily --.

Column 14,
Line 24, delete “an” and insert -- and --.
Line 35, after “includes” delete “a”.

Signed and Sealed this

Seventh Day of June, 2005

JON W. DUDAS
*Director of the United States Patent and Trademark Office*